US011964801B1

(12) United States Patent
Mazurkiewicz

(10) Patent No.: US 11,964,801 B1
(45) Date of Patent: Apr. 23, 2024

(54) CLOSURE FOR A CONTAINER AND CONTAINER WITH SUCH A CLOSURE

(71) Applicant: Aptar Freyung GmbH, Freyung (DE)

(72) Inventor: Timothy Mazurkiewicz, Waukesha, WI (US)

(73) Assignee: Aptar Freyung GmbH, Freyung (DE)

( * ) Notice: Subject to any disclaimer, the term of this patent is extended or adjusted under 35 U.S.C. 154(b) by 0 days.

(21) Appl. No.: 17/769,137

(22) PCT Filed: Nov. 11, 2019

(86) PCT No.: PCT/EP2019/080895

§ 371 (c)(1),
(2) Date: Apr. 14, 2022

(87) PCT Pub. No.: WO2021/093936

PCT Pub. Date: May 20, 2021

(51) Int. Cl.
*B65D 47/08* (2006.01)
*B65D 47/32* (2006.01)

(52) U.S. Cl.
CPC ..... *B65D 47/0828* (2013.01); *B65D 47/32* (2013.01); *B65D 2205/02* (2013.01); *B65D 2251/1008* (2013.01)

(58) Field of Classification Search
CPC . B05B 11/0044; B65D 47/06; B65D 47/0828; B65D 47/32; B65D 2205/02; B65D 2251/1008
See application file for complete search history.

(56) References Cited

U.S. PATENT DOCUMENTS

2008/0210709 A1* 9/2008 Wohlgenannt ..... B65D 47/40 222/111
2012/0074180 A1 3/2012 Kallenbach
2017/0056904 A1* 3/2017 Brugger ..... B65D 47/32

FOREIGN PATENT DOCUMENTS

DE 7818747 U1 9/1978
JP 2009286465 A 12/2009

OTHER PUBLICATIONS

Written Opinion and Search Report dated Aug. 26, 2020 for PCT/EP2019/080895 of which this is subject application a US National Phase.

* cited by examiner

*Primary Examiner* — Donnell A Long
(74) *Attorney, Agent, or Firm* — Wood, Phillips, Katz, Clark & Mortimer

(57) ABSTRACT

The present invention relates to a closure for a container, wherein the closure comprises a base element and a flip-top lid attached to said base element by a hinge, such that the flip-top lid can be moved between an opened and a closed position, wherein said closure comprises a spout for dispensing a fluid material. Said spout has a first dispensing opening and a second dispensing opening, whereas said spout additionally comprises a vent opening. The present invention also relates to a system with a container and such a closure, wherein said closure is directly or indirectly attached or attachable to said container.

22 Claims, 6 Drawing Sheets

CLOSURE FOR A CONTAINER AND CONTAINER WITH SUCH A CLOSURE

FIELD OF THE INVENTION

The present invention relates to a closure for a container and to a system with a container and with such a closure. Such closures are typically used for dispensing products contained in a container to which said closure is attached.

The products to be dispensed are typically fluid products, like e.g. liquids or powdered or granular products, e.g. in the food or beverage area, but also in other applications, e.g. for cleaning substances, detergents or other products.

BACKGROUND OF THE INVENTION

The present invention especially relates to a closure having a flip-top lid being attached to a base element by a hinge, while such a flip-top lid can be moved between an opened and closed position, while said flip-top lid is typically rotated around said hinge and around an axis of rotation between its opened and its closed position.

Such closures are for example known from EP 2 121 466 B1.

It is an object of the present invention to provide an enhanced closure for a container and an enhanced system comprising a container and such a closure. Especially it is an object of the present invention to provide an enhanced closure or system which is specifically user-friendly and which provides the user with the possibility to dispense different amounts of fluid stored in such a container and to be dispensed through said enhanced closure more easily.

BRIEF SUMMARY OF THE INVENTION

This object is solved by a closure for a container according to claim 1 and a system with a container and such a closure according to claim 22. Claims 2 to 21 refer to specifically advantageous realizations of the closure according to claim 1.

The closure according to the present invention comprises a base element and a flip-top lid attached to said base element by a hinge such that the flip-top lid can be moved between an opened and a closed position. Preferably said flip-top lid is rotated around an axis of rotation between its opened and its closed position.

The closure according to the present invention also comprises a spout for dispensing a fluid material, wherein said spout can be a separate element, attachable to or attached to said base element, but said spout can be also integrally formed with said base element.

According to the present invention said spout has a first dispensing opening and a second dispensing opening, said first and said second dispensing opening being separate from each other and having a different size and/or a different cross-sectional form. Additionally said spout has a vent opening, being separate from both said first and said second dispensing opening and being arranged at least partly between the first and the second opening.

Such a closure has the advantage that it provides two separate dispensing openings having different dispensing or pouring properties, so that the user can choose one of the dispensing openings, namely the dispensing opening whose dispensing or pouring properties are more suitable for the currently desired dispensing activities. The user may therefore select one of the dispensing openings, being for example larger than the other dispensing opening, in case the user wants to dispense a high amount of fluid, so that the dispensing takes less time. Alternatively the user may select a dispensing opening being smaller than the other dispensing opening, in case the user wants to dispense a lower amount of fluid or in case the user wants to more precisely control the amount of fluid to be dispensed.

The vent opening being provided in addition and being positioned at least partly between said first dispensing opening and said second dispensing opening ensures a more controlled dispensing, especially as it at least partly separates the first dispensing opening from the second dispensing opening and as it enables a controlled entry of air through the vent hole and into the container during the dispensing. The clear arrangement of the three separate openings therefore not only provides controlled dispensing activities, avoiding potentially undesired turbulences of fluid to be dispensed, securing, at least to a large extent, an essentially laminar dispensing flow of the fluid to be dispensed, but also gives a clear guidance to the user how the dispensing could be correctly controlled, typically by tilting the container in order to pour liquid through one of the two dispensing openings, which can be selected by the direction of tilting the container. The clearer separations between each of the openings, the two dispensing openings and the vent opening, do further assist the user in how to operate the device and gives a clear guidance as to the amount of tilting of the container being necessary or most convenient to generate a controlled and essentially laminar dispensing of the fluid.

According to a preferred embodiment said first and said second dispensing opening are arranged, in a circumferential direction of the closure, opposite to each other. This arrangement has the advantage that the user can simply select the direction into which the system, especially the container with the closure, has to be tilted in order to select one of the dispensing openings, by tilting the container either into one direction or into the opposite direction. The tilting directions are therefore separated as far as possible from each other making a clear selection easier for the user and also limiting the potential effects of not exactly matching the correct tilting direction by the user.

In a further preferred embodiment said first opening and said second opening are axially symmetric to an axis being parallel to an axis of rotation, around which the flip-top lid is rotated when being moved between said open and said closed position. This axis is preferably not only a horizontal axis being parallel to the axis of rotation of said flip-top lid but also extending through the middle of the closure.

In this sense and in connection with the description of the closure according to the present invention, the closure has a vertical axis or z-axis, extending in a vertical direction. In case of a base element, which has an essentially cylindrical outer form or a cylindrical skirt, as it is typically or frequently the case, see also the embodiment shown later on in this specification, this vertical axis or z-axis is also the longitudinal axis of this cylindrically formed base element or skirt. The upward direction of this vertical axis or z-axis is the direction where the flip-top lid is positioned, the flip-top lid defining an upper part of the closure, whereas the downward direction of this vertical axis or z-axis is the direction where the base or base element is positioned, defining a lower part of the closure. The lower part of the closure is therefore the part of the closure which is attached or attachable to a container, whereas the upper part of the closure is the part of the closure where the flip-top lid is arranged, in opposite side of the closure which is attached or attachable to a container.

In addition to this vertical axis or z-axis, there are also two horizontal axes, a cross axis or x-axis and a longitudinal axis or y-axis, being normal to each other and being normal to the vertical axis or z-axis, thereby defining a coordinate system. The longitudinal axis or y-axis extends through the middle of the closure and through the middle or the center of the hinge, whereas the cross axis or x-axis extends normal thereto.

According to a preferred embodiment said first and said second opening are adapted and positioned such that the main pouring direction or the primary pouring direction of the first opening is positioned opposite to the main pouring direction or the primary pouring direction of the second opening. The main or primary pouring direction of the opening is typically the direction into which the container is tilted in order to optimally use the dispensing opening, where it is typically the center of a dispensing opening through which the fluid is dispensed first when tilting the container.

The pouring directions of the first opening and the second opening are preferably parallel to a plane defined by an axis of rotation, around which the flip-top lid is rotated when being moved between said opened and said closed position and the vertical axis or z-axis of the closure. The pouring directions are especially preferably in a direction being in a plane defined by said vertical axis or z-axis and said cross axis or x-axis.

According to a preferred embodiment, the middle or center of the hinge defines a 12 o'clock position, in a top view from above the closure downwardly longer vertical axis or z-axis, wherein the first opening and the second opening are arranged such that their center or an axis of symmetry, provided that it is a closure in which said openings are axially symmetric, preferably the cross axis or x-axis, are in a 3 o'clock position and in a 9 o'clock position, respectively.

These arrangements have the specific advantage that said first and said second opening are not only arranged in opposite directions, but also such that the flip-top lid, when being in its opened position, is always at a side position, independent on which of the dispensing opening is used by a user, thereby ensuring that the flip-top lid is not disturbing the dispensing activities and the flow of the fluid to be dispensed.

According to a further preferred embodiment the height of the spout, especially the height of the spout relative to the deck of said base element or an upper plane of such a deck of said base element, is constant over a circumferential angular distance of more than 180°, preferably over a circumferential angular distance of more than 210° or even 240°. Furthermore, the spout has a bulge or indentation or a reduced height in an angular position being closest to said hinge, wherein said bulge or indentation or reduced height extends over a circumferential angular distance of at least 30°, preferably over a circumferential angular distance of at least 60° or even of at least 90°. a preferred range over which the indentation extends, in a circumferential direction, is between 80° and 160°, preferably between 90° and 140°, further preferably between 100° and 130°.

This specific arrangement has the advantage that the constant height over a large or even the major part of the circumferential area of the closure supports a controlled and especially laminar dispensing flow through each of the dispensing openings, when the device is handled correctly and in case the user selects one of the dispensing openings and dispensing directions, but it also has the advantage that even in case of an incorrect handling of the device, e.g. by a user tilting a container in a direction away from the hinge, with respect to the above-mentioned top view into a 6 o'clock position, the dispensing flow is still kept essentially laminar, while avoiding the dripping of liquid onto the closure, especially onto the neck or other parts of the base element. However, in a circumferential direction, in which the hinge is provided and in the vicinity of which the closure is positioned when it is in its opened position, and indentation or bulge is provided, which thereby avoids using of more material, thereby reducing the weight of the closure, while additionally any undesired abutment of parts of the flip-top lid with the spout during opening and closure of the flip-top lid, which is rotated around a rotational axis, is avoided, thereby securing a smooth opening and closing of the flip-top lid and avoiding any wear of the spout or parts of the flip-top lid, which could affect the sealing properties of the closure when the flip-top lid is in its closed position.

Additionally, depending on the kind of hinge being utilized for a connection between base element and flip-top lid, more space for parts of the hinge is available, thereby providing more flexibility for the selection of and the design of the hinge, while still avoiding any potentially undesired contact of parts of the hinge or the flip-top lid with parts of the spout, thereby also avoiding wear of the spout or parts of the flip-top lid, which could affect the sealing properties of the closure.

These specific arrangements do not only provide more flexibility for the design of the hinge, but also more flexibility for the design of the spout, especially the size of the spout, especially in a radial or circumferential direction, both in absolute dimensions but also relative to the total size of the closure or the base element. Especially the bulge or indentation could provide a possibility to enlarge the radial extensions of the spout and to move the spout closer to the hinge, while still a contact of any parts of the hinge or the flip-top lid with parts of the spout can be avoided, as these parts could move close to or even partly into the bulge or indentation. This is of specific advantage in cases where a higher amount of fluid has to be dispensed, while still the total dimensions of the closures have to be kept limited.

In a preferred embodiment said closure has only one such bulge or indentation, especially in the area being closest to the hinge, in order to ensure the above-mentioned advantages, while otherwise keeping the height of the spout on a constant level, in order to secure a smooth dispensing and laminar flow, both for dispensing through one of the dispensing openings when the container and the closure is utilized in a correct form, but also in case of mishandling of the device by the user, as described above.

According to a preferred embodiment, the minimum height of said bulge or indentation is a maximum 70%, preferably at maximum 60% and preferably in a range of 50% to 70% of the maximum height of the spout. It has been found that these values are preferred ranges in order to achieve the above-mentioned advantages in a specifically preferred way.

According to a further specifically preferred embodiment the spout comprises a web being arranged within an opening of said spout, while said web bridges said opening of the spout, thereby defining said first opening and said second opening on opposite sides of said web. Additionally the web itself has an inner opening which defines said vent opening. This arrangement has the specific advantage that the three openings, namely the two dispensing openings and the vent opening, are clearly separated, while the web is easy to manufacture, especially by injection molding.

According to a specific realization said web is positioned, with respect to the vertical axis or z-axis below or lower than the minimum height of said spout. Preferably said web is positioned, with respect to its height or its vertical axis or z-axis, on a level or essentially on a level corresponding to a deck or a deck portion of said base element. In one embodiment said web is designed and positioned such that an upper plane of said web is positioned below an upper edge of said spout at each angular position of said spout. In a specific embodiment said upper plane of said web is positioned at least 2 mm, preferably at least 3 mm, below an upper edge of said spout at an angular position where said bulge indentation has its minimum height. This arrangement has the advantage that there is a distance between the web and the upper edge of the spout, preferably at any angular position of the spout, further securing an undisturbed dispensing and an essentially laminar flow of the fluid to be dispensed.

In a specific embodiment said web comprises an inner extension wall surrounding said vent opening extending from said web into an inward or downward direction. This inner extension wall has the advantage of an even more clear separation of the vent opening from the dispensing openings, securing that, even with a not absolutely correct handling of the device by a user, e.g. by tilting the container to strongly, the fluid is only dispensed through one of the dispensing opening, avoiding an entry of the fluid or even a dispensing of the fluid through the vent opening, at least until a certain extent of mishandling of the device.

According to a specific embodiment the closure provides the base element with the tongue member extending upwardly (in a vertical direction or that direction or at least with a component in said vertical direction or sets direction) from an upper region or an upper plane of said base member, wherein said flip-top lid has a protrusion extending outwardly from said flip-top lid in a direction normal to (or having at least normal component to) the vertical axis or z-axis. The tongue and the protrusion are arranged such that they interact with each other, thereby creating a bistable system, in which the flip-top lid is pushed into a direction towards its fully opened position when said flip-top lid is in the predetermined second angular range. This arrangement provides more defined positioning of the flip-top lid, especially in its fully opened position. In respect it is also especially referred to the advantages of the bulge or indentations, as a closure according to such a specific embodiment requires potentially more space for the hinge or the tongue and the projection supporting the opening and closing of the flip-top lid. In one specific embodiment the tongue may even partly extend into said bulge or indentation of said spout, especially when said flip-top lid is in its fully opened position or in a position where the flip-top lid is in its bistable position, where it is pushed into either the fully open position or into the direction of the closed position and only slightly being brought out of bistable position.

The inventors have found that the selection of sizes of the first and the second opening are working especially preferable in case the larger opening is larger than the smaller opening by a factor of at least 1.5, preferably by a factor of at least 2, further preferably at least by factor 2.5. Furthermore, with respect to the size of the vent opening, the inventors have found that it is especially preferable when the smaller dispensing opening has a size being larger than the size of the vent opening by at least factor 1.2, preferably by at least factor 1.5, further preferably by at least factor 2.

In a preferred embodiment the curvature of the first opening, especially at radially outward points, is different from the curvature of the second opening, especially at radially outward points, preferably in an opposite angular position. Preferably, the curvature of the larger of the first or the second opening is smaller than the curvature of the smaller of the first or the second opening at opposing radially outward positions with respect to a horizontal axis (x-axis) being normal to a vertical axis (z-axis) of said closure. This supports the dispensing or pouring properties of the dispensing openings.

Preferably, said flip-top lid has an inner sealing wall, extending from an inner side of said flip-top lid and being arranged and positioned such that it comes into the sealing contact with said spout, preferably with an inner region of said spout, when said flip-top lid is in its closed position, such that both the first and the second opening and the vent opening are sealed by the interaction of said inner sealing wall with said spout. Such an arrangement has the advantage that all openings, including the vent opening, are automatically sealed to the outside when the flip-top lid is in its closed position.

It also has to be noted that in case of such an arrangement, the above-mentioned bulge or indentation of the spout, in the area of or near to the hinge, has the specific advantage that it avoids an early abutting of said inner sealing wall with said spout during the closing movement of said flip-top lid, which is, as explained above, due to the hinge, a rotational movement. The sealing properties can therefore be securely maintained, also over a long period of utilization (lifetime) of the closure, with many cycles of opening and closing the flip-top lid.

The present invention also relates to a system with a container with a closure as described above, wherein said closure is attachable or attached to the container or wherein said closure is integrally formed with the container. If the closure is attachable or attached to the container, both said closure and said container comprises fastening means, which can interact with each other. In cases where the closure is integrally formed with the container, it is possible that the system is manufactured at least partly as a unitary system, e.g. the base element or part of the base element could be integrally formed with a part of the container. It is also possible to create such a system by fastening the closure and the container together by various attachment systems, for example by welding or gluing.

BRIEF DESCRIPTION OF THE DRAWINGS

These and other advantages of the closure and the system according to the present invention will become even more apparent in view of the following figures showing a preferred embodiment of a closure according to the present invention.

DETAILED DESCRIPTION OF THE PREFERRED EMBODIMENTS

Figure 1:
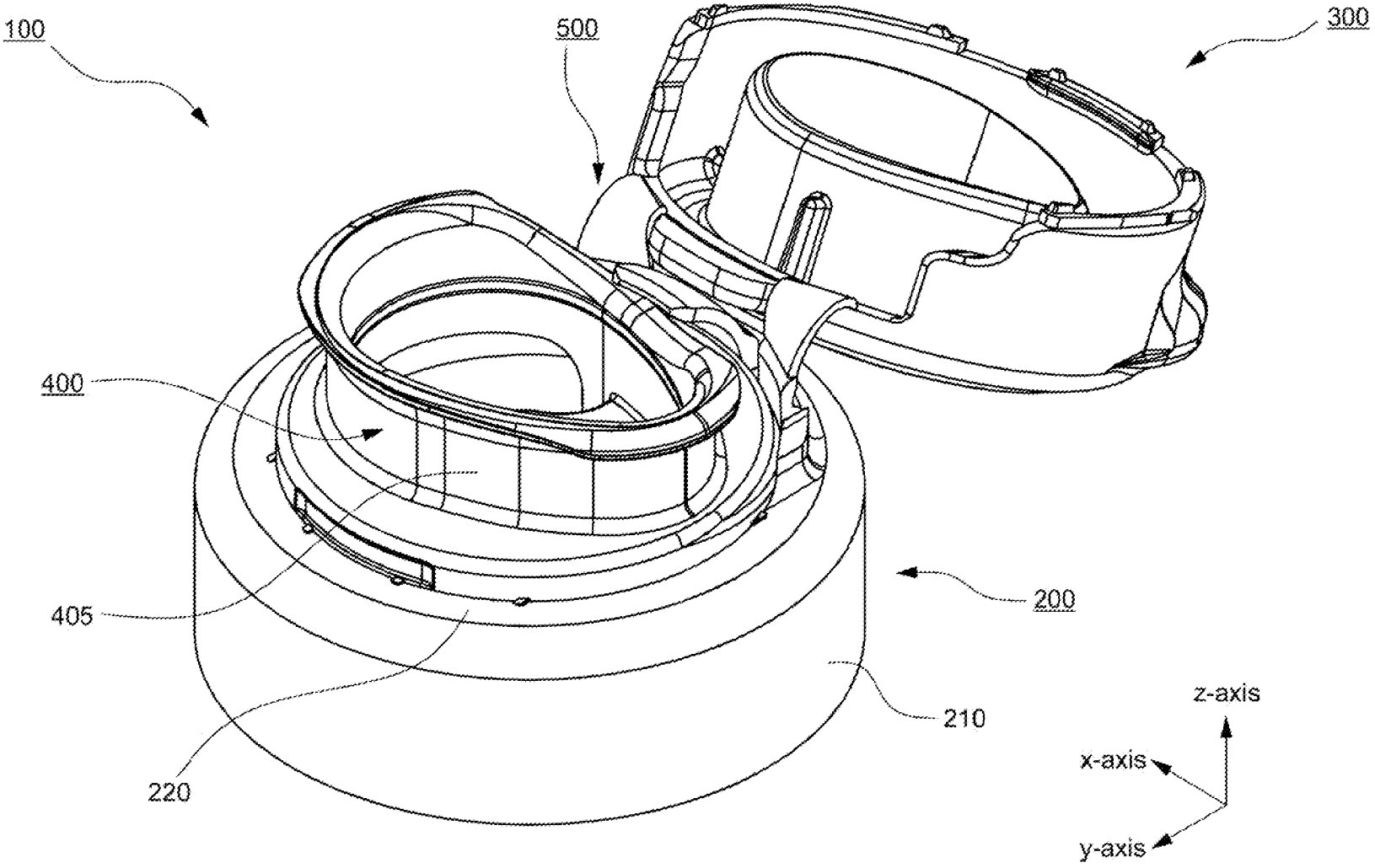
FIG. 1 shows a perspective view of an embodiment of the closure according to the present invention with the flip-top lid being in its fully opened position.

FIG. 1 shows a perspective view of an embodiment of the closure 100 according to the present invention comprising a base element 200 with a cylindrical skirt 210, a spout element or spout 400 and a flip-top lid 300 being attached to the base element 200 via a hinge 500. The flip-top lid 300 is in its fully opened position, so that the spout 400 is free for dispensing a fluid. The spout 400 extends with its spout walls 405 beyond the base element 200 and especially above or beyond a deck 220 of the base element 200, while the height of the spout wall 405 is essentially constant or constant over a major part of its circumference, but the spout 400 has a bulge or indentation 490 in an angular position being close to the hinge 500.

Figure 2:
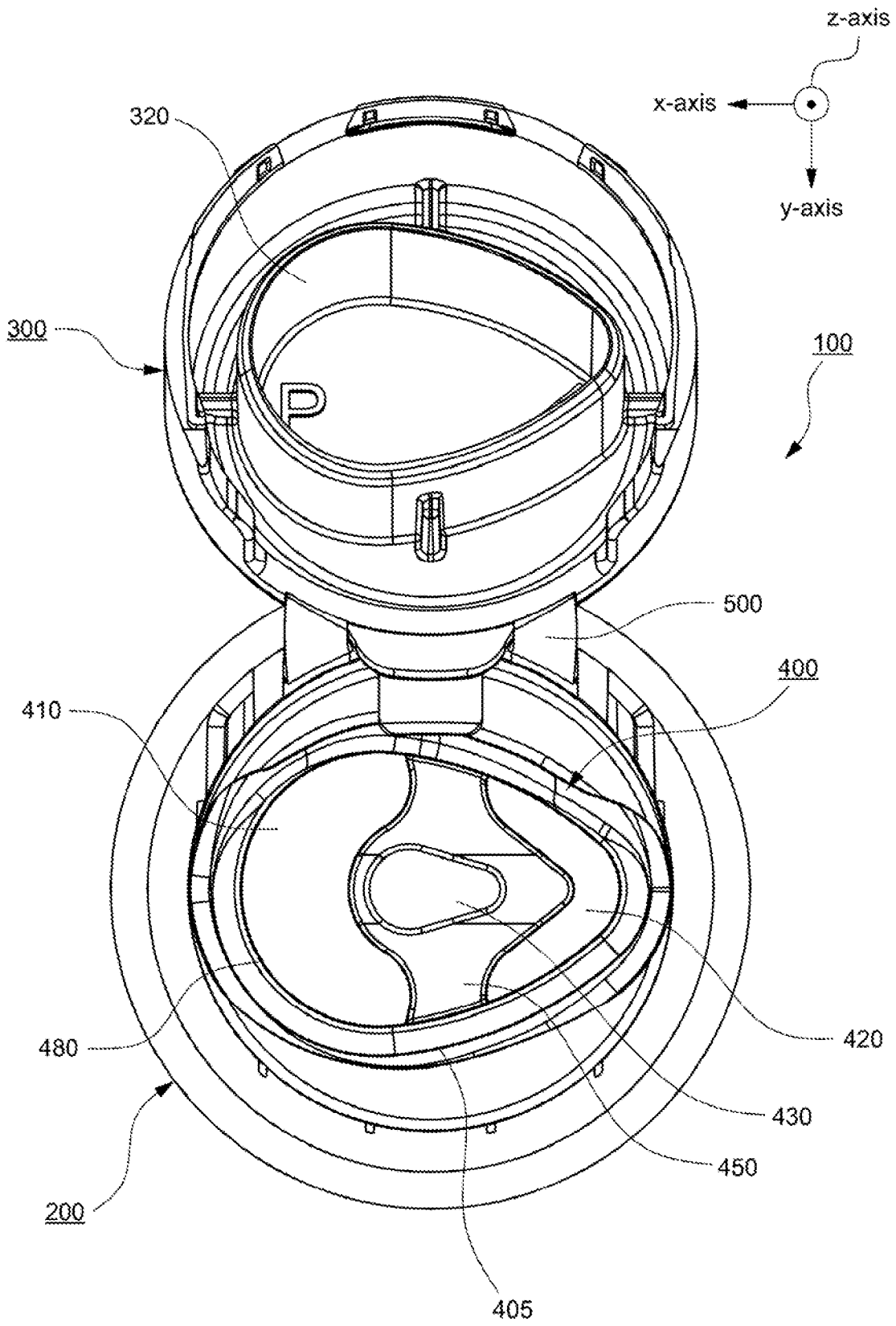
FIG. 2 shows a top view of the embodiment of the closure according to the present invention as shown in FIG. 1 in a downward direction along the vertical axis, z-axis

FIG. 2 shows a top view the embodiment as shown in FIG. 1, from an upper position in a downward direction along the vertical z-axis. As can be well seen in FIG. 2 the inside of the a spout wall 405 of the spout 400 has an opening 480, which is separated into a first dispensing opening 410, a second dispensing opening 420 and a vent opening 430. The spout 400 also comprises a web 450, which separates the first dispensing opening 410 fully from the second dispensing opening 420, while the vent opening 430 is provided within the web 450.

In this top view, in a vertical downward direction along the vertical axis, z-axis, the position of the hinge or the middle or center of the hinge marks a 12 o'clock position, while the center of the first dispensing opening 410 is in the 9 o'clock position and the center of the second dispensing opening 420 is in the 3 o'clock position. The web 450 extends essentially along the y axis and separates the first dispensing opening 410, being, in this view, on the left side, from the second dispensing opening 420, being, in this view, on the right side.

The 3 o'clock position and the 9 o'clock position mark the main or primary pouring directions for the first dispensing opening 410 and the second dispensing opening 420, respectively, which would be a preferred arrangement also for other embodiments. Furthermore, both the first dispensing opening 410 and the second dispensing opening 420 are axially symmetric relative to the x-axis, and also this is an arrangement which is preferred also for other embodiments.

In this embodiment the first dispensing opening 410 is larger than the second dispensing opening 420, and in this specific embodiment the first dispensing opening 410 has a cross-sectional area of about 60 $mm^2$, while the second dispensing opening 420 has a cross sectional area of about 24 $mm^2$. The cross-sectional area of the vent opening 430 is about 16 $mm^2$ large. While the two dispensing openings 410, 420 always have different sizes, the specific selection of the cross-sectional areas can be adapted to the specific situation in other embodiments. Preferably the vent opening is always smaller than both the first dispensing opening 410 and the second dispensing opening 420.

As can be also seen in the two figures, FIG. 1 and FIG. 2, the indentation 490 extends in the area around and from the 12 o'clock position and over an angular distance of about 120°, while the angular area of the spout 400, which has a constant height, extends over an angular distance of about 240° (see also FIG. 4 and the corresponding description hereinafter).

As can be well seen in FIG. 2 as well, both the first dispensing opening 410 and the second dispensing opening 420 have an essentially U-form or V-form cross-section, which is very preferable for a controlled pouring or dispensing of liquid, especially in connection with the vent hole 430 provided between the first dispensing opening 410 and the second dispensing opening 420 as well as especially in connection with the web 450 separating these two dispensing openings. While other cross-sectional forms are also possible, this specific U-form or V-form cross-section is preferred, also for and in other embodiments.

Figure 3:
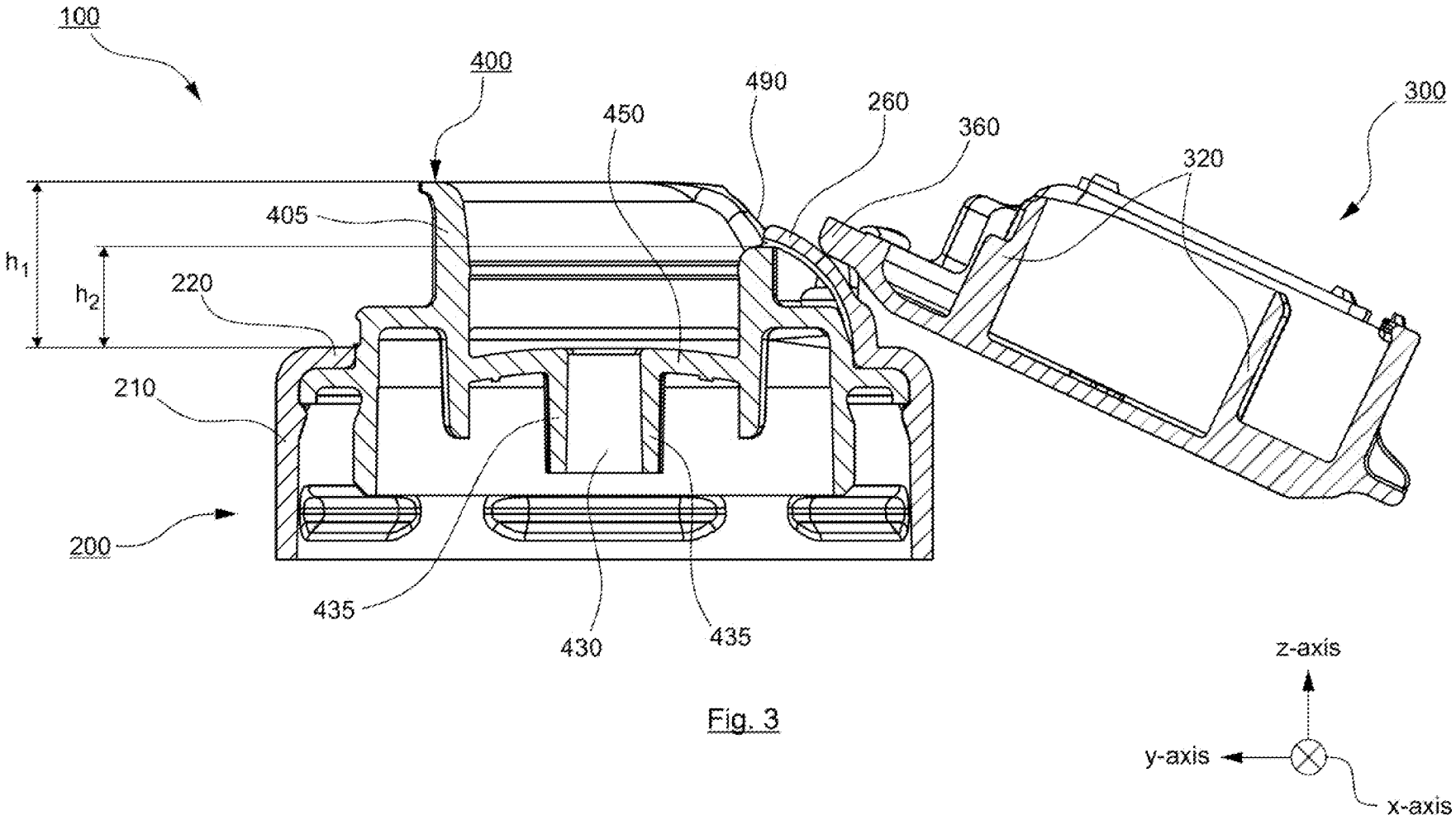
FIG. 3 shows a cross-sectional view of the embodiment as shown in FIGS. 1 and 2, the cross-section being along the plane defined by the vertical axis, z-axis, and a horizontal axis, y-axis, which extends through the center or middle part of said hinge of said closure, with the flip-top lid being in its fully opened position.

FIG. 3 shows the embodiment of the closure as shown in FIG. 1, however in a cross-sectional view. As can be well seen the spout 400 is, in this embodiment, a separate element, which is inserted into the base element 200 and secured thereto. However, it also has to be mentioned that it would be also possible in other embodiments to have a spout being integrally formed with the base element.

The spout wall 405 has, over a majority of its circumference, a constant height h1, measured from the deck 220 of said base element 200, while the spout wall 405 has, in the vicinity of the hinge 500, a bulge or indentation 490. The indentation 490 has its minimum height h2 at a position of the circumference of the spout wall 405 being, in a circumferential direction, closest to the hinge 450. The indentation 490 extends, in this embodiment, over an angular range of about 130°, while the height of the spout wall 405, measured relative to the deck 220 of the base element 200, increases, from its lowest height h2, at its portion being closest to the hinge element 500, gradually until reaching its maximum height h2, which it then keeps constant over the remaining area or circumferential range of the spout wall 405.

As can be well seen in FIG. 3 the spout 400, being a separate element, is inserted into and fixed to the base element 200, in this embodiment by a snap fitting attachment. The spout 400 is also integrally formed with the web 450, which comprises the vent hole 430. Said web 115 also comprises an inner extension wall 435, which surrounds the vent hole 430. This inner extension wall 435 has especially the advantage that liquid to be dispensed is, at least to a certain extent, prevented from entering into the vent hole 430, thereby securing a correct functioning of the closure, even if the potential handling by the user should not be perfect, thereby especially ensuring a proper and laminar dispensing of liquid over broad range.

FIG. 3 also visualizes an interaction between a tongue 260, extending from a deck 220 of the base element 200 in an upward direction, and the protrusion 360 extending from said flip-top lid 300, essentially in an outward or radially outward direction. Due to the flexibility and elasticity of the tongue 260, the tongue 260 does, in this position of the flip-top lid 300, exerts a force onto said flip-top lid 300, via the projection 360, which pushes or keeps the flip-top lid 300 into its fully opened position.

Figure 4:
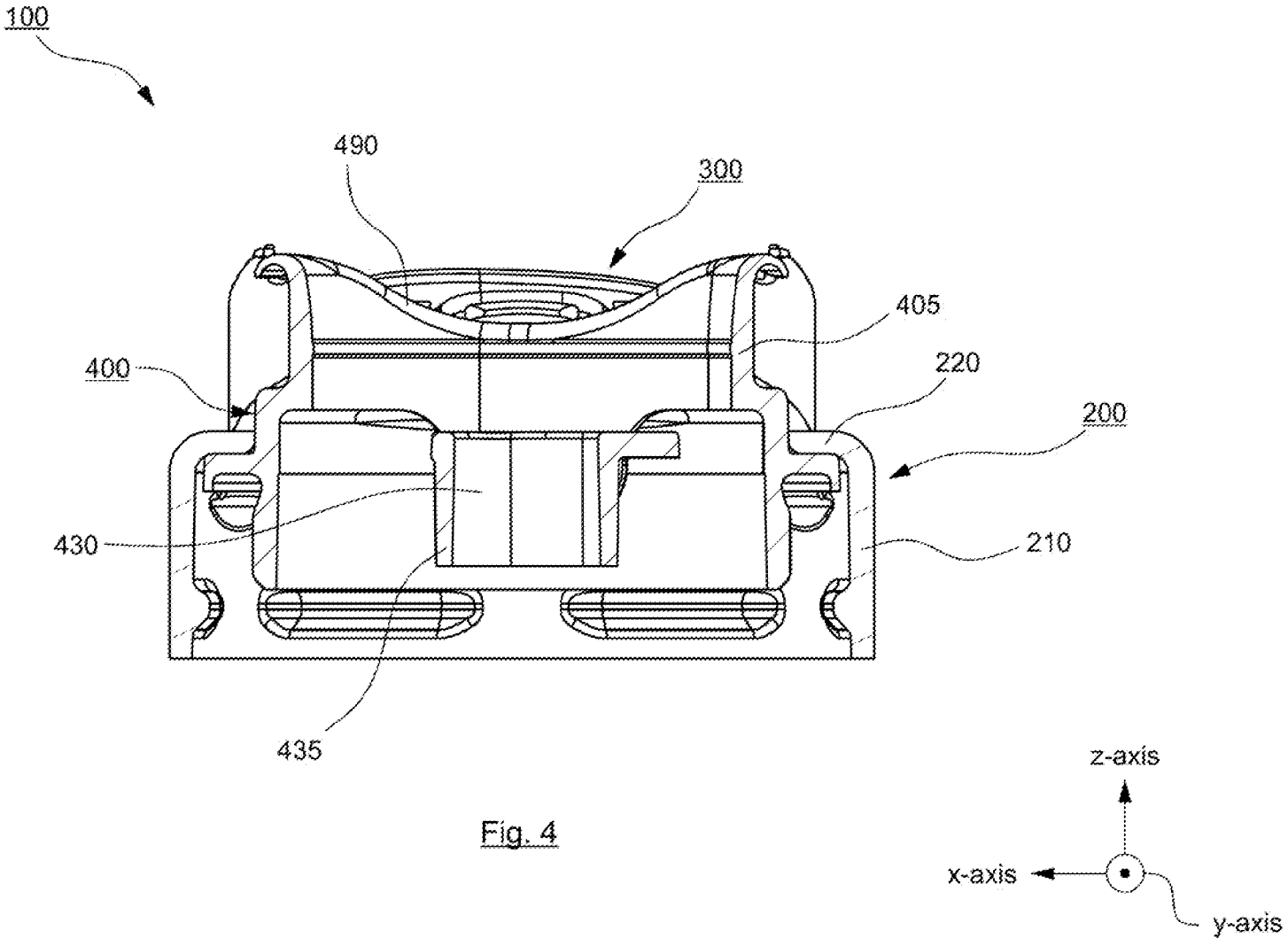
FIG. 4 shows a partial cross-sectional view of the embodiment as shown in FIGS. 1 and 2 along a plane defined by the x-axis and the z-axis, with flip-top lid being in its fully opened position.

FIG. 4 shows a partial cross-sectional view of the embodiment as shown in FIG. 3 along a plane defined by the x-axis and the z-axis, with the flip-top lid 300 being in its fully opened position (therefore a partial cross-sectional view from the left side, when referring to FIG. 3).

As the front side (with respect to the view shown in FIG. 4) is cut away, the indentation 490 of the spout 400 or of the spout wall 405 is very well visible, with its minimum height in the vicinity of the hinge, and the height gradually increasing in both directions until reaching its maximum height, which is then kept constant, as explained above.

Figure 5:
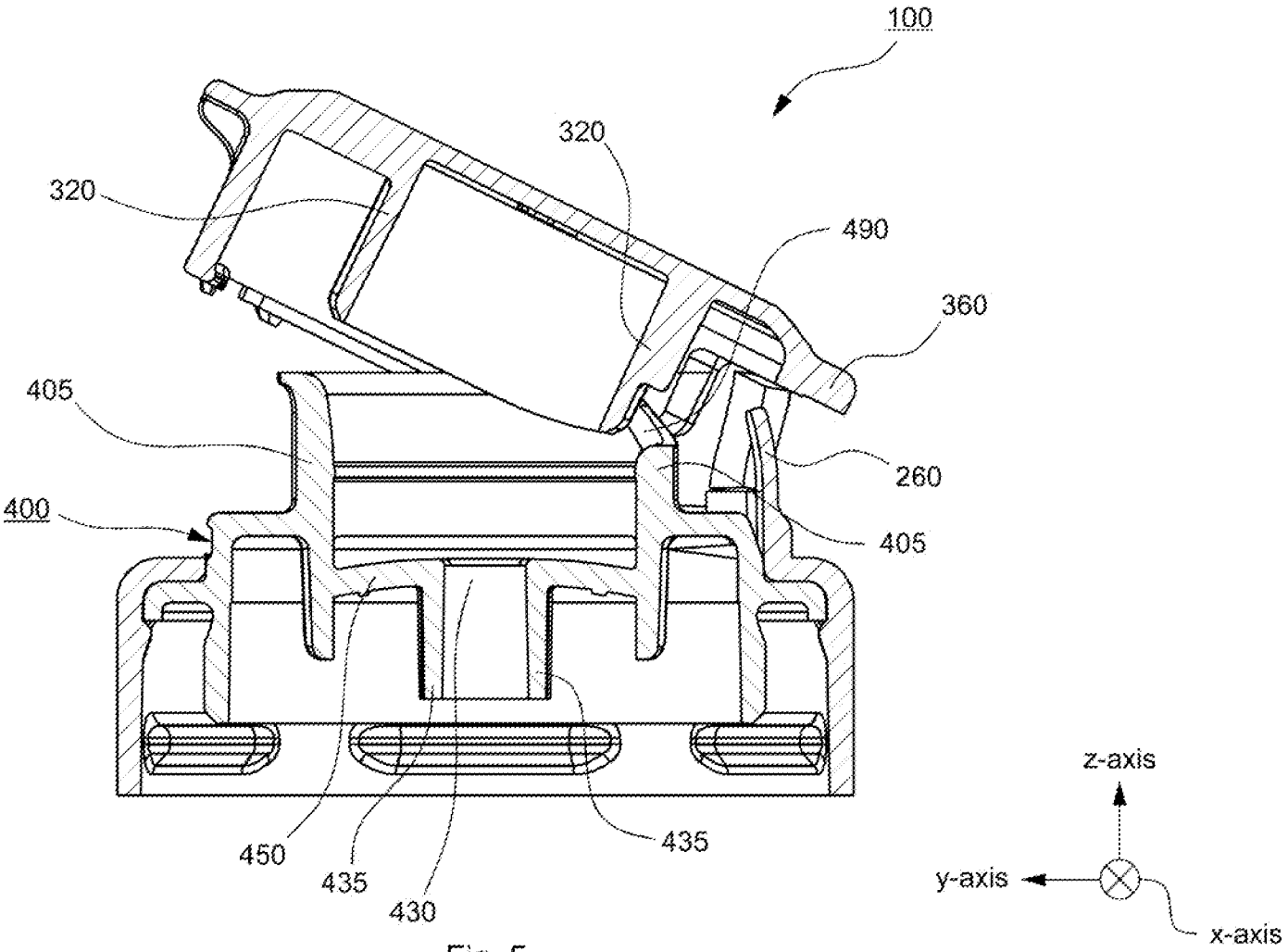
FIG. 5 shows a cross-sectional view of another embodiment of the closure according to the invention, along a plane defined by the y-axis and the z-axis, with the flip-top lid being in an intermediate position between its fully opened and its fully closed position.

FIG. 5 shows a cross-sectional view of another embodiment of the closure 100 according to the present invention, while the cross-section is very similar to the presentation of the first embodiment as shown in FIG. 3, however with the flip-top lid 300 being in an intermediate position, closer to the closed position of the flip-top lid 300. This embodiment is very similar to the embodiment shown in the earlier figures, so that the same or similar elements are referred to by the same reference numbers.

As can be well seen in FIG. 5 the indentation 490 of the spout wall 405 provides sufficient space for other elements of the flip-top lid 300, especially for an inner sealing wall 320, extending from an inner side of the flip-top lid 300, which avoids, at least until a certain extent, an abutment of said inner sealing wall 320 with parts of the spout wall 405, which avoids wear at these very sensible parts, having a major function for the sealing capabilities of the closure.

Figure 6:
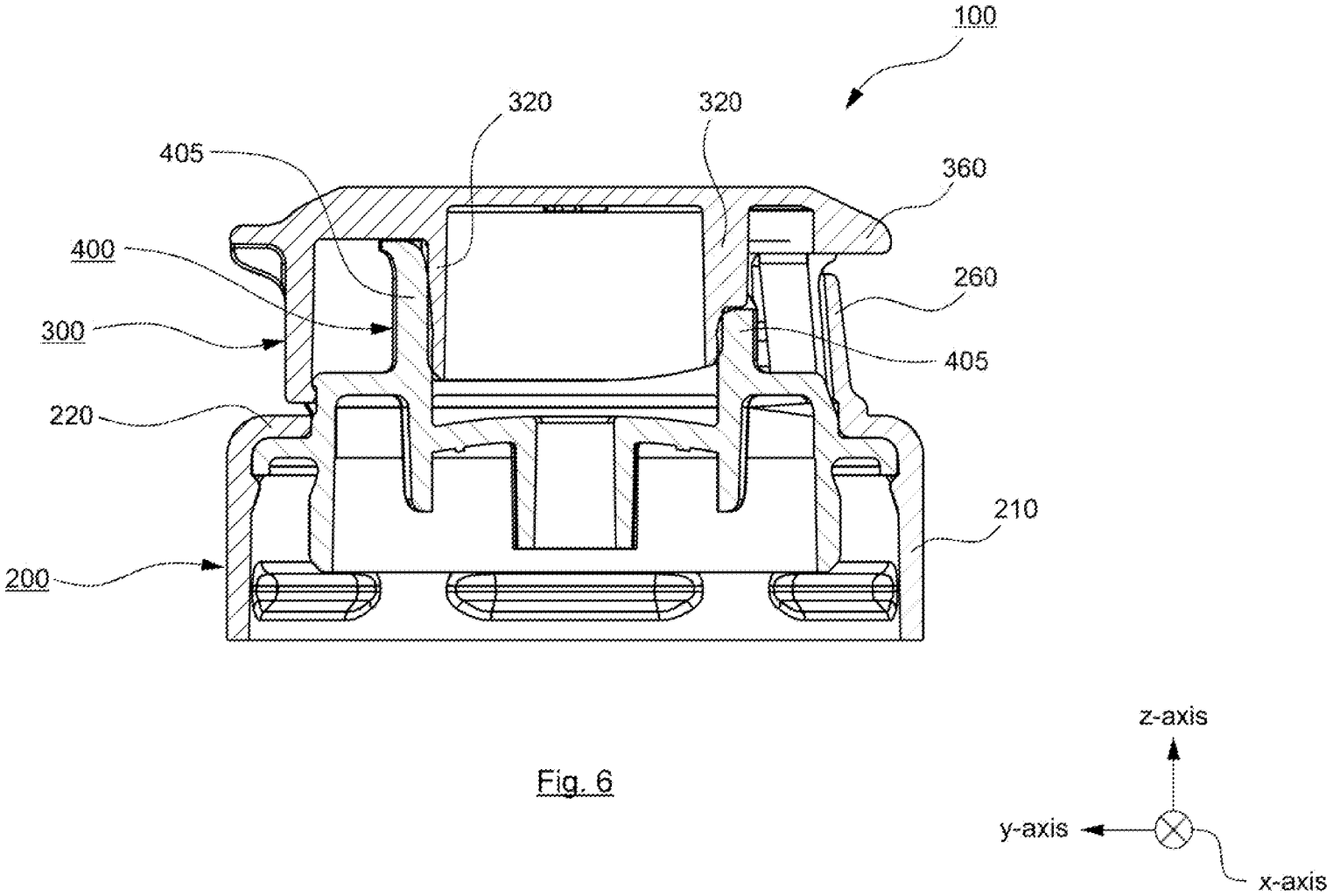
FIG. 6 shows the cross-sectional view of the embodiment as shown in FIG. 5, with the flip-top lid being in its fully closed position.

FIG. 6 shows the embodiment as shown in FIG. 5, however, with the flip-top lid 300 in its fully closed position. As can be well seen in FIG. 6, the inner sealing wall 320 seals against an inner part of the spout wall 405, whereas, in the area of the indentation (490, see especially FIG. 5) the sealing wall 320 has a stepped or a cornered portion which seals against the corresponding parts of the spout wall 405.

Such a realization has therefore the specific advantage that the sealing properties and capabilities are not only at a high level after manufacturing, but due to the fact that wear is avoided, for the above-mentioned reasons, these sealing capabilities are also maintained during use of the closure, securing a long lifetime of the closure.

It is clear to the expert that various amendments can be made to the embodiments without departing from the scope of the present invention as defined by the attached claims, and any features disclosed in connection with the embodiments or the general description can be important for realizing the invention, either alone or in any combination thereof.

The invention claimed is:

1. Closure (100) for a container with a base element (200), a flip-top lid (300) attached to said base element (200) by a hinge (500) such that the flip-top lid (300) can be moved between an opened and a closed position, wherein said closure (100) comprises a spout (400) for dispensing a fluid material, wherein said spout (400) has a first dispensing opening (410) and a second dispensing opening (420), said first (410) and said second dispensing opening (420) being separate from each other and having a different size and/or a different cross-sectional form, wherein said spout (400) additionally has a vent opening (430), being separate from both said first dispensing opening (410) and said second dispensing opening (420) and being arranged at least partly between the first dispensing opening (410) and the second opening (420).

2. Closure (100) according to claim 1, wherein said first (410) and said second dispensing opening (420) are arranged, in a circumferential direction of the closure (100), opposite to each other.

3. Closure (100) according to claim 1 wherein said first opening (410) and said second opening (420) are axially symmetric to an axis (x-axis) being parallel to an axis of rotation, around which the flip-top lid (300) is rotated when being moved between said opened and said closed position.

4. Closure (100) according to claim 1, wherein said first (410) and said second opening (420) are adapted and positioned such that a main pouring direction of the first opening (410) is opposite to a main pouring direction of the second opening (420), wherein the pouring directions of the first opening (410) and the second opening (420) are parallel to a plane defined by an axis of rotation, around which the flip-top lid (300) is rotated when being moved between said opened and said closed position and a vertical axis (z-axis) of the closure (100).

5. Closure (100) according to claim 1, wherein, in a top view from above the closure downwardly along a vertical axis (z-axis), a middle or center of the hinge (500) defines a 12 o'clock position, wherein the first opening (410) and the second opening (420) are arranged such that their center or an axis of symmetry, in case said first and second dispensing openings (410, 420) are axially symmetric, are in a 3 o'clock position and in a 9 o'clock position, respectively.

6. Closure (100) according to claim 1, wherein a height (h1) of the spout (400) or of a spout wall (405) is constant over a circumferential angular distance of more than 180°, wherein the spout (400) has a bulge or indentation (490) or a reduced height in an angular or circumferential position being closest to said hinge (500), wherein said bulge or indentation (490) or reduced height extends over a circumferential angular distance of said spout (400) or said spout wall (405) of at least 30°.

7. Closure (100) according to claim 6, wherein said closure (100) has only one bulge or indentation (490).

8. Closure (100) according to claim 6, wherein a minimum height (h2) of said bulge or indentation (490) is at maximum 70% of a maximum height (h1) of the spout wall (405) relative to a deck (220) of said base element (200).

9. Closure (100) according to claim 1, wherein the spout (400) comprises a web (450) being arranged within an opening (480) of said spout (400) or within a spout wall (405) of the spout (400) and bridging said opening (480) of the spout wall (405) or the spout (400), thereby defining said first opening (410) and said second opening (420) on opposite sides of said web (450), wherein the web (450) itself has an inner opening which defines said vent opening (430).

10. Closure (100) according to claim 9, wherein said web (450) is positioned, with respect to a vertical axis (z-axis), below a minimum height (h2) of said spout wall (405).

11. Closure (100) according to claim 9, wherein said web (450) is positioned, with respect to a vertical axis (z-axis), on a level or essentially on a level corresponding to a deck (220) or a deck portion of said base element (200).

12. Closure (100) according to claim 9, wherein said web (450) is designed and positioned such that an upper plane of said web (450) is positioned below an upper edge or a minimum height (h2) of said spout wall (405) or said spout (400) at each angular or circumferential position of said spout (400).

13. Closure (100) according to claim 9, wherein said web (450) is designed and positioned such that an upper plane of said web (450) is positioned at least 2 mm below an upper edge of said spout wall (405) or said spout (400) at an angular or circumferential position where said bulge or indentation (490) has its minimum height (h2).

14. Closure (100) according to claim 9, wherein said web (450) comprises an inner extension wall (435), surrounding said vent opening (430) and extending from said web (450) into an inward or downward direction.

15. Closure (100) according to claim 1, wherein said base element (200) has a tongue member (260) extending from an upper region or an upper plane of said base member (200) into an upward direction along the vertical axis (z-axis), wherein said flip-top lid (300) has a protrusion (360) extending outwardly from said flip-top lid (300) in a direction being normal to the vertical axis (z-axis), said tongue member (260) and said protrusion (360) being positioned and arranged such that, during a movement of said flip-top lid (300) between its fully closed and its fully opened position, said protrusion (360) and said tongue member (260) are, over a first predetermined angular range of the position of the flip-top lid (300) relative to the base element (200) during its movement between its fully closed and its fully opened position, in contact with each other, such that the protrusion (360) exerts a force onto said tongue member (260) into an inward direction and said tongue member (260) exerts a counterforce to said protrusion (360), such that, when said flip-top lid (300) is within a second predetermined angular range relative to said base element (200), said counterforce supports a movement of said flip-top lid (300) in a direction towards its fully opened position, wherein said tongue element (260) or an outer surface thereof preferably extends, in an upper part thereof, at least partly into an inward direction.

16. Closure (100) according to claim 15, wherein said closure (100) is designed and arranged such that there is at least one position of said flip-top lid (300) during its movement between its fully opened and its fully closed position, in which said tongue member (260) extends at least partly into a bulge or indentation (490) of said spout (400).

17. Closure (100) according to claim 1, wherein the size of said first opening (410) is larger than the size of said second opening (420) by at least factor 1.5, preferably at least by factor 2, further preferably by at least factor 2.5.

18. Closure (100) according to claim 1, wherein the size of the vent opening (430) is smaller than the size of each of the first and second opening, wherein the smaller of the first or second openings (410, 420) has a size being larger than the size of the vent opening (430) by at least factor 1.2.

19. Closure (100) according to claim 1, wherein the curvature of the first opening (410), at radially outward points, is different from the curvature of the second opening, at radially outward points, in an opposite angular position.

20. Closure (100) according to claim 1, wherein the curvature of the larger of the first or the second opening (410, 420) is smaller than the curvature of the smaller of the first or the second opening (410, 420) at opposing radially outward positions with respect to a horizontal axis (x-axis) being normal to a vertical axis (z-axis) of said closure.

21. Closure (100) according to claim 1, wherein said flip-top lid (300) has an inner sealing wall (320), extending from an inner side of said flip-top lid (300) and being arranged and positioned such that it comes into a sealing contact with said spout (400), when said flip-top lid (300) is in its closed position, such that both the first and the second opening (410, 420) and the vent opening (430) are sealed by the interaction of said inner sealing wall (320) with said spout (400).

22. System comprising a container and comprising a closure according to claim 1, wherein said closure (100) is directly or indirectly attached or attachable to said container.

* * * * *